United States Patent [19]

Morgan

[11] 4,069,783

[45] Jan. 24, 1978

[54] METHOD OF AND APPARATUS FOR DISAGGREGATING PARTICULATE MATTER

[75] Inventor: George W. Morgan, Dallas, Tex.

[73] Assignee: Sun Oil Company Limited, Calgary, Canada

[21] Appl. No.: 740,896

[22] Filed: Nov. 11, 1976

[51] Int. Cl.[2] ..... B63B 35/12

[52] U.S. Cl. ..... 114/42; 241/29; 299/25; 299/89

[58] Field of Search ..... 114/40–42; 299/24–26, 36, 84, 89; 241/27, 29, 30, 189 R, 191

[56] References Cited

U.S. PATENT DOCUMENTS

| | | | |
|---|---|---|---|
| 958 | 10/1838 | Hunt et al. | 114/40 |
| 2,699,327 | 1/1955 | Cartlidge | 299/89 |
| 2,730,344 | 1/1956 | Cartlidge | 299/89 |
| 2,754,102 | 7/1956 | Kraft et al. | 299/89 |
| 3,307,875 | 3/1967 | McDowell | 299/84 |
| 3,667,416 | 6/1972 | Fioravanti et al. | 114/42 |
| 3,696,624 | 10/1972 | Bennett | 114/42 |
| 3,754,791 | 8/1973 | Hoermann | 299/36 |
| 3,766,737 | 10/1973 | Howard | 114/42 |
| 3,791,328 | 2/1974 | Schirtzinger | 114/42 |
| 3,888,544 | 6/1975 | Bennett | 299/86 |
| 3,965,835 | 1/1976 | Bennett | 114/42 |

*Primary Examiner*—Stephen G. Kunin
*Assistant Examiner*—Stuart M. Goldstein
*Attorney, Agent, or Firm*—J. Edward Hess; Donald R. Johnson; James H. Phillips

[57] ABSTRACT

An ice disaggregation system comprising a multiplicity of aligned and successively longer sledging teeth outwardly extending from a rotatable drum. The drum rotation allows the successively longer teeth to sequentially cut and chip deepening grooves in various forms of particulate matter such as ice or coal engaged by the system. A second form of slugging tooth, outwardly extending from the drum, is provided in generally central alignment between paired rows of sledging teeth. The slugging tooth is positioned to subsequently engage the isolated, ridged sections of ice between successive grooves therein, and for striking said ridges with sufficient force to impart shear fracture thereto. The drum is provided with a plurality of sledging and slugging teeth in staggered groups comprising a spiral configuration along the drum. In this manner the system is particularly adapted for sequentially disaggregating engaged ice floes in a vertically descending direction for permitting the broken sections thereof to be carried freely upward by the buoyant force of the water therebeneath.

8 Claims, 8 Drawing Figures

METHOD OF AND APPARATUS FOR DISAGGREGATING PARTICULATE MATTER

BACKGROUND OF THE INVENTION

The invention relates to a method of and apparatus for disaggregating particulate matter, and, more particularly, to a cutting-striking mass removal system including a rotatable drum having staggered arrays of sledging and slugging teeth outwardly extending therefrom.

In the petroleum exploration and production industry it is often necessary to station men and equipment in relatively hostile environmental regions. In recent years the emphasis on oil production from the far north has necessitated development of new techniques for encountering formations of encroaching ice floes and the movements thereof which threaten the stability and/or position of equipment situated therearound.

In the Arctic, large offshore regions are often covered by thick layers of ice. The recovery of minerals beneath these frozen waters requires the penetration of sections of ice for equipment installation. Similarly, once drilling platforms are installed and secured above boreholes therebeneath, it is important to keep the adjacent ice packs away from the moored platform structure. It is particularly necessary to have the capability of engaging an ice floe moving against and around such platforms so that the platform remains relatively stationary in conjunction with the borehole depending therefrom. The enormous mass of the moving ice in such regions has created a formidable problem fostering the need for effective means for expeditiously breaking up imposing ice layers.

Prior art ice removal systems have sought to provide cutters and chippers generally upon vertical or horizontal rotating drums, often operated in pairs, with axes of rotation being generally parallel. In Artic regions of platform operation, such cutters may be mounted on the bow of tugs which may circle drilling and production platforms to engage and cut the encroaching ice. This design and approach facilitates a cutting-grinding action in the ice pack by "eating" away at the face of the abutting portions. Although effective in breaking up solidified, brittle masses, the conventional cutting-grinding technique is antiquated. For example, a single rotating cutter of conventional construction generally produces parallel spaced shallow serrations with ridges therebetween in the ice. The serrations are spaced close enough together to allow a second rotating cutter and/or blades, providing equally parallel, shallow serrations, to grind up the ice ridges left from the first cutter. Because the ice is being struck, chipped and grooved in repetitious parallelism, the structural vulnerability of the ice ridges between serrations due to weakness in the shear mode is not addressed. Once a ridge is produced between two serrations in the face of a sheet of ice, it would take considerably less force to break and shatter the ridge by fracturing it in shear than it would to cut the ridge as a normal serration. With the "shear" approach, the initial serrations could actually be cut deeper and spaced further apart than is conventionally provided with normal cutters. In the same vein, it may be seen that it would take fewer teeth upon a drum to impart shear fracture blows to enlarged serrated ice ridges to accomplish the same degree of ice removal indicative of conventional parallel chipper systems.

It would be an advantage thereto, to overcome the disadvantages of prior art ice cutting and removal systems by providing means for effectively forming laterally weakened, enlarged ridges in masses of ice, and the like, and subsequently striking the ridges to create shear fracturing therein. The method and apparatus of the present invention are provided for just such a purpose and for applications involving other particulate matter, such as coal. A spiral array comprising groups of sledging and slugging teeth are provided. The sledging teeth are adapted to engage the ice and cut sequentially deeper serrations therein; and the slugging teeth are adapted to strike the ice ridges formed between serrations in such a manner as to cause shear fracture therein. The encountered ice, coal, or the like, may then be systematically cut, shattered and removed in either an ascending or descending direction depending on the orientation of drum rotation and conditions therearound. In this manner, less energy may be required to break up imposing ice layers or to cut through layers of coal, as the case may be. Similarly, mass removal may be effected in a more sophisticated and efficient fashion when particulate matter is involved.

SUMMARY OF THE INVENTION

The invention relates to a method of and apparatus for disaggregating formations of particulate mass, such as ice, including a rotatable drum having arrays of teeth outwardly extending therefrom. Rotation of the drum produces involved mass removal effectiveness by first cutting and chipping serrations therein to form structurally weakened ridges therebetween. More particularly, one aspect of the invention includes a drum mounted for generally vertical rotation and engagement with the particulate matter and having staggered arrays of sledging and slugging teeth outwardly extending therefrom for sequentially serrating the engaged matter and then striking the weakened ridges to impart fracture thereto in a shear mode. The arrays of teeth are staggered to provide disaggregation in a selected longitudinal direction depending on the manner of rotation. Means are provided for rotating the drum in the direction and manner most appropriate for the type of matter engaged.

In another aspect of the invention a system is provided for disaggregating particulate matter including at least one rotatable drum having aligned pairs of sledging teeth of progressively increasing length extending therefrom. Adjacent each array of aligned pairs of sledging teeth, centrally positioned therebetween and to the rotative rear thereof, there is provided a slugging tooth adapted for striking engagement with the particulate matter engaged and laterally isolated therebefore by the sledging teeth. The drum may be provided on the end of a boom and/or the bow of a ship, tractor or other apparatus, for engaging and disaggregating particulate matter, abutted thereby. The removal and/or disaggregation of particulate matter such as ice, coal, and the like is thereby readily facilitated.

In yet another aspect of the invention a method for disaggregating particulate matter is provided, including the step of serrating the matter with a plurality of generally parallel serrations to form laterally weakended ridges therebetween. The ridges are struck, generally centrally thereof, with a striking element for imparting shear fracture thereto and the breaking away of the ridged mass from between serrations. More particularly, one aspect of the invention includes the provision of first and second sets of outwardly extending teeth upon a rotatable drum, which teeth are adapted for respectively cutting and striking particulate matter engaged thereby. The drum is rotated with the first set of teeth cutting grooves in the face of the matter and the second set of teeth successively striking the ridges of matter formed between the grooves. In this manner, a method is provided for removing particulate matter such as ice or coal with maximum effectiveness.

BRIEF DESCRIPTION OF THE DRAWINGS

For a more complete understanding of the present invention, and, for further objects and advantages thereof, reference may now be had to the following description taken in conjunction with the accompanying drawings, in which.

DETAILED DESCRIPTION

Figures 1, 2, 3, 4, 5:
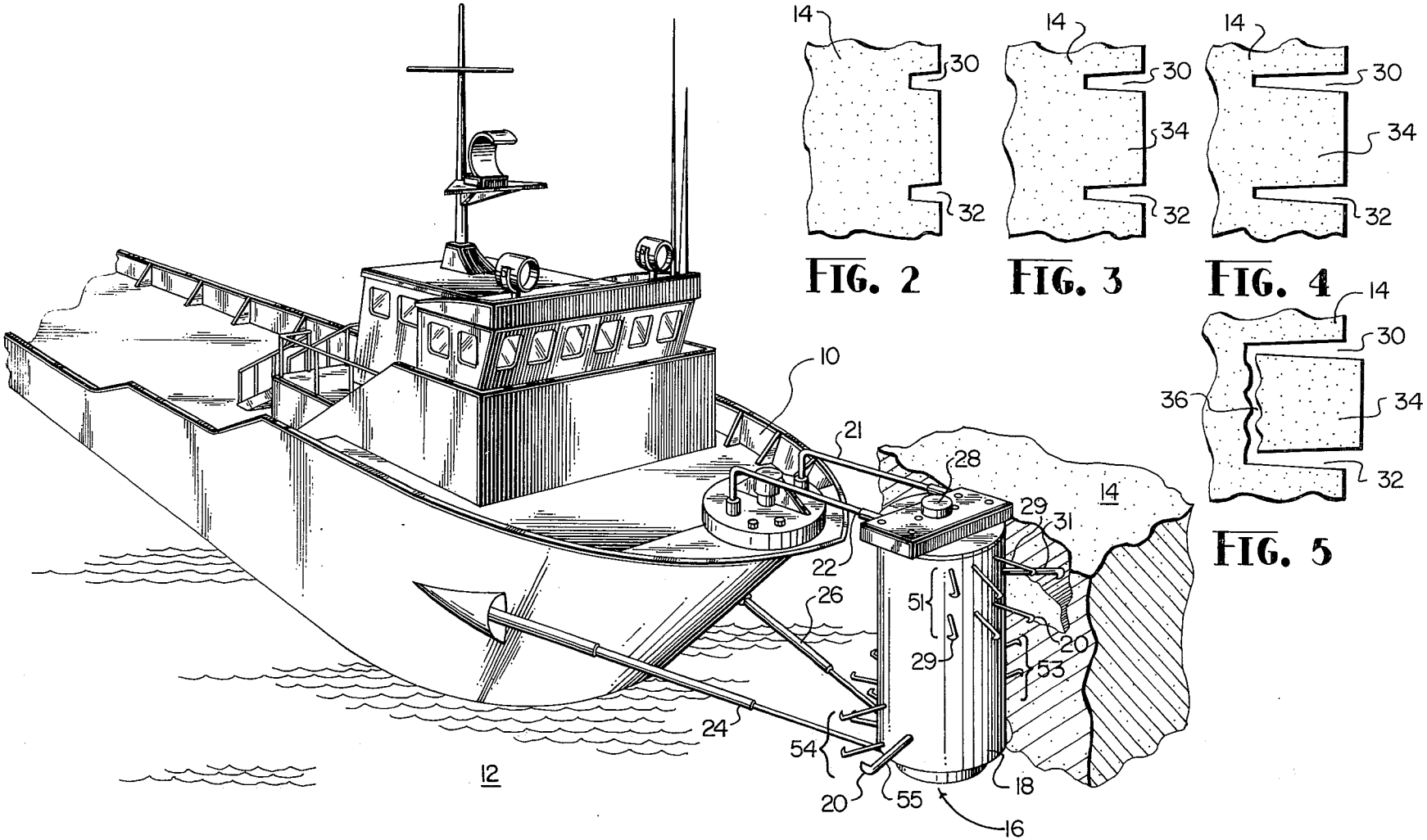
FIG. 1 is a perspective view of one embodiment of ice disaggregating apparatus constructed in accordance with the principals of the present invention and mounted upon the bow of a boat illustrated in engagement with an ice floe.
FIG. 2 is an enlarged fragmentary cross-sectional view of a vertical section of ice illustrating a primary phase of disaggregation through engagement with the apparatus of FIG. 1.
FIG. 3 is an enlarged fragmentary cross section view of the section of ice illustrated in FIG. 2 after a secondary phase of disaggregation through engagement with apparatus of FIG. 1.
FIG. 4 is an enlarged fragmentary cross-sectional view of the section of ice of FIG. 2 after a third phase of disaggregation through engagement with the apparatus of FIG. 1.
FIG. 5 is an enlarged fragmentary cross-sectional view of the section of ice of FIG. 2 after a fourth phase of disaggregation through engagement with the apparatus of FIG. 1.

Referring first to FIG. 1, there is shown a perspective view of one embodiment of a method of and apparatus for disaggregating particulate matter in the form of ice. A water craft or boat 10 is shown for purposes of illustration upon a body of water, or seas, 12, and in abutting engagement with an ice floe 14, shown in fragmentary cross section for purposes of clarity. The boat 10 is structurally adapted for the mounting of ice disaggregation apparatus, in the form of ice chipper 16, upon portions of the bow thereof, and for the operation of said apparatus in accordance with the principles of the present invention.

The particular embodiment of the ice chiper 16 as shown includes a generally cylindrical drum 18 having ice disaggregation teeth 20 in the form of sledging and slugging spikes extending outwardly therefrom. The drum 18 of the present embodiment is rotatably mounted and supported in generally vertical alignment by a pair of upper support struts 21 and 22 and lower support arms 24 and 26. The craft 10 is complementally constructed and adapted for supporting and piloting said support struts 21 and 22 and arms 24 and 26 in the respective operational mode as described hereinbelow. The lower support arms 24 and 26 preferably include hydraulic cylinders and a telescoping construction, adapted for effecting select movement and position of the drum 18. Rotation of the drum 18 is preferably effected through suitable drive means powered from within the boat 10. The drive means may include conventional hydraulic pump (not shown) supplying a hydraulic motor 28 atop the drum 18 with sufficient pressure fluid to effect rotation thereof. Supply lines for the motor 28 may be provided within the support struts 21 and 22 and/or the support arms 24 and 26. In this manner the requisite drive mechanism for the drum 18 may be relatively small in size and positionable outboard the boat 10 for maximum effectiveness.

Figure 6:
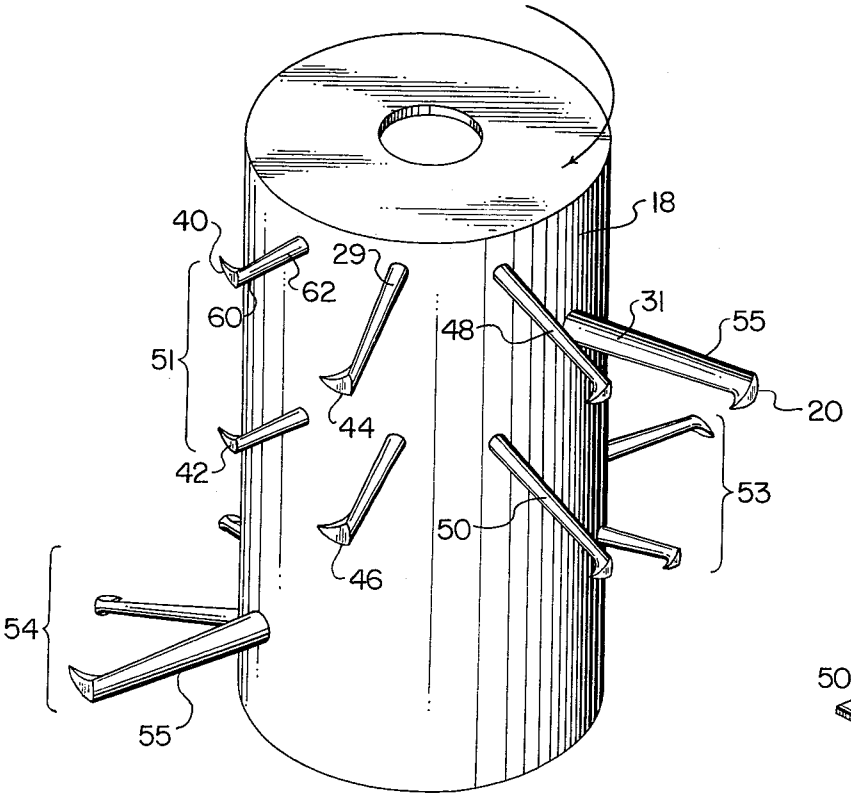
FIG. 6 is an enlarged perspective view of the particular embodiment of the rotatable drum comprising a portion of the ice disaggregation apparatus shown in FIG. 1.

Referring now to FIG. 6, ice disaggregation teeth 20 are provided upon the outer surface 29 of drum 18, in longitudinally disposed rows of sledging and slugging spikes 29 and 31 respectively. The sledging spikes 29 are comprised of spikes of graduated lengths, extending radially from the drum 18 for engaging the ice 14 and sledging, or cutting, deepening serrations therein. As the drum 18 rotates, the sledging spikes 29 serially engage the ice 14 through each rotation. As shown most clearly in FIGS. 2–5 there is illustrated enlarged cross sections of ice 14 exhibiting pairs of parallel grooves, or serrations 30 and 32. The serrations of FIG. 2 are formed therein by primary, or leading, sledging teeth 40 and 42. As shown in FIG. 3, serrations 30 and 32 have been deepened to form an enlarged, laterally isolated ridge of ice 34 therebetween. The deepened serrations 30 and 32 are formed by further revolution of the drum 18 and engagement with secondary sledging teeth 44 and 46.

As shown most clearly in FIGS. 4 and 5, the cutting action of the sledging spikes 29 renders the ice vulnerable to shear fracture. Referring now to FIG. 4, there is shown a third view of the ice section 14 after engagement with a third set of sledging teeth 48 and 50. The parallel serrations 30 and 32 may be seen to have been further enlarged to form a further elongated and laterally isolated ice ridge 34 therebetween. The ice ridge 34 of FIG. 4 may be now seen to be structurally weak from a lateral shear mode, rendering this portion of the ice 14 susceptible to breakage. Referring now to FIG. 5, the ice section 14 is shown with the parallel serrations 30 and 32 joined by a ridge separation, or fracture 36 adjacent the inward end of the ice ridge 34. The separation of the ridge 34 from the ice 14 has been diagrammatically effected through further revolution of the drum 18 in such a manner as to impart fracture behind the ridge 34, as will be discussed in more detail below.

Still referring to FIG. 6, the enlarged perspective view of the drum 18 more clearly illustrates an array 51 of sledging teeth 29 of graduated length outwardly extending therefrom. The teeth 29 of array 51 are provided in longitudinally disposed pairs comprising the primary cutting teeth 40 and 42 rotatively ahead of the secondary cutting teeth 44 and 46. Secondary cutting teeth 44 and 46 may be seen to be longer in length, providing for the deepened serrations, as are the third phase cutting teeth 48 and 50. The respective teeth 29 are provided in longitudinal pairs in the embodiment shown for the purpose of isolating the ridge section 34 therebetween. It may be seen that disaggregation teeth 29 are also disposed beneath and to the rotative rear of the array 51 to comprise a second array 53. The teeth 29 of second array 53 are provided singularly, rather than in pairs, because only one serration need be cut beneath upper serration 32 in order to isolate a ridge of ice therebetween. Similarly a third array 54 of teeth 20 is provided beneath and to the rotative rear of second array 53, and said third array is also comprised of a single row of sledging spikes 29. The sledging spikes 29 of the three arrays illustrated herein are preferably provided in the graduated length configuration above described and typified by teeth 40, 44 and 48. In this manner of construction a drum 18 may be provided with any number of disaggregation teeth 29 and arrays thereof. The spiral configuration of arrays 51, 53 and 54 is preferable in that it permits maximized energy application through teeth engagement of the ice in seriation. Moreover, the spiral array facilitates ice removal effectiveness as will be discussed in more detail below.

The laterally isolated ice ridge 34 of FIGS. 2–4 is illustrative of the type of preliminary ice disaggregation produced by the teeth 29 of arrays 53 and 54 of FIG. 6. Actual ice breakage and removal, as illustrated in FIG. 5, is effected by striking the ice ridge 34 with the slugging spike 55 in such a manner as to impart fracture between the ridge and the remaining body of ice 14. Therefore, upper array 51 includes slugging tooth 55 generally centrally positioned between the rotative paths of teeth 48 and 50 and to the rotative rear thereof. Tooth 55 is constructed to initially strike the laterally isolated ridge 34 at point between the respective ends of serrations 30 and 32 and to then impart a sufficient blow to the body of said ridge to propagate a line of fracture between said ridge and the mass of ice 14 therebehind. Since the path of travel of the spikes 29 and 31 and the resultant serrations 30 and 32 is arcuate, due to rotation of drum 18, the fracture 36 may become segmented, with incomplete sections of ridge 14 breaking away. However, because the path of travel of tooth 55 is also arcuate with relation to the ice 14, the remaining arcuate sections of ridge 34 will be broken away in like manner.

Ice disaggregation with drum 18 is effected by rotation thereof in the direction of the arrow provided in FIG. 6. Rotation in this manner produces ice engagement and disaggregation in a vertically descending direction. It may thus be seen that upper array 51 engages and disaggregates an ice ridge 34 before intermediate array 53 engages the ice. Similarly lower tooth array 54 engages the ice only after intermediate array 53 has effected breakage thereabove. Ice fracturing and breakage occurring in a descending direction therein permits the encompassing water therearound to assist in removing the broken ice fragments through its inherent buoyant force. Were the ice 14 broken from the bottom toward the top or simultaneously therealong, as in conventional methods, the broken fragments thereof would quickly interfere with the floating ascension and removal of one another. The spiral configuration of the teeth arrays 51, 53 and 54 therefore facilitate the removal of the fragmented ice sections without necessitating the expenditure of additional energy.

Figure 7:
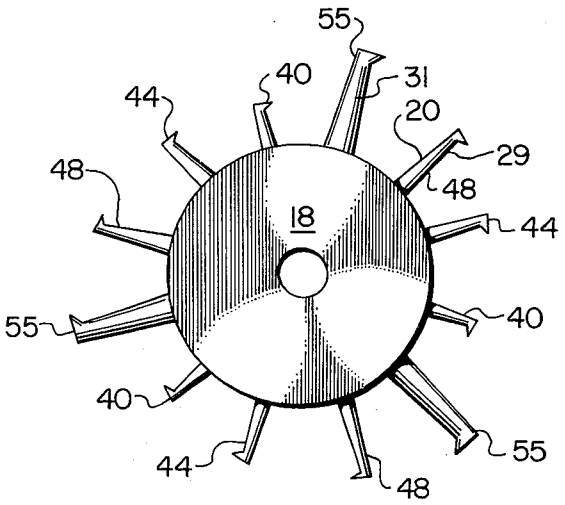
FIG. 7 is a top plan view of the particular embodiment of the rotatable drum of FIG. 6, illustrating the staggered lengths of the disaggregation teeth outwardly extending therearound.

For purposes of further illustrating the construction of the drum 18 and its operation which facilitates the aforementioned improved ice removal effectiveness, a top plan view of the drum is provided. Referring now to FIG. 7, the disaggregation teeth 29 and 31 are shown to be constructed as radial extensions of the drum 18. The slugging teeth 55 are provided in proportionally spaced, staggered positions about the drum 18 and between respective arrays of cutting-chipping or sledging teeth 29 formed thereon. The disaggregation teeth 20, as a whole, are preferably formed in the aforementioned groups longitudinally along and about the drum 18 for providing the aforesaid cutting-chipping-disaggregation action with a 360° drum rotation. Continuous rotation of the drum 18 may thus be seen to impart sequential, fragmented disaggregation in a descending path.

Figure 8:
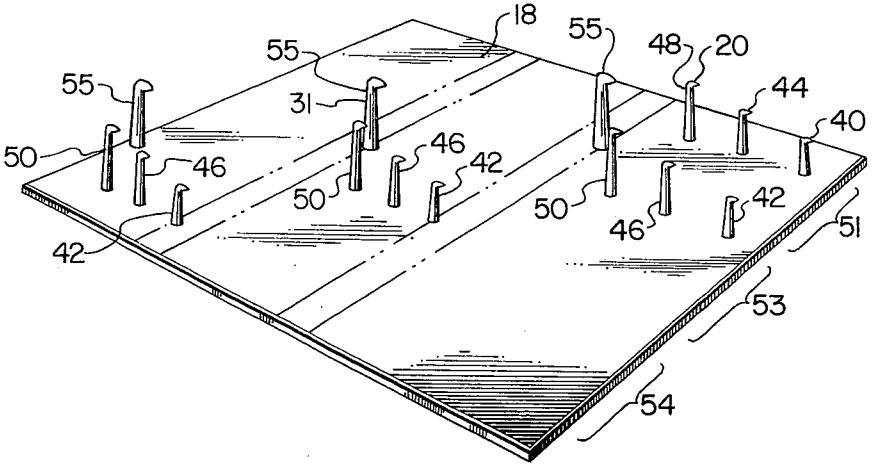
FIG. 8 is a diagrammatic representation of the surface area of the drum of FIG. 6, illustrating the relative positioning of the sledging and slugging teeth extending outwardly therefrom.

Referring now to FIG. 8, the drum 18 and disaggregation teeth 20 are illustrated in a diagrammatical representation of drum 18 in a flat pattern. The disaggregation teeth 20 may be more clearly seen in the staggered arrays 51, 53 and 54 as perspectively illustrated in FIG. 6. The intermediate array 53 of disaggregation teeth 20 formed to the rotative rear of the upper array 51 is comprised of only a lower flight of sledging teeth 42, 46 and 50, as mentioned above. A single slugging tooth 55 is likewise provided to the rotative rear thereof and generally centrally aligned between the sledging teeth 29 of the upper and intermediate arrays 51 and 53 respectively. The lower array 54 of sledging teeth 29 is similarly provided to the rotative rear of the intermediate array 53 and is comprised also of only a lower flight of sledging teeth 42, 46 and 50 rotatively in advance of a single slugging tooth 55. The flat pattern of the drum 18 thus further illustrates how rotation thereof provides cutting-chipping-disaggregation of engaged particulate matter in a vertically descending direction.

Referring again now to FIG. 1 it may be seen that operation of the drum 18 outboard of the boat 10 imparts disaggregation to the engaged ice 14 in such a manner that the seas 12 can effectively float the disaggregated pieces of ice upwardly and away from the remaining consolidated ice 14 as the various laterally isolated sections 34 are broken off. However, the width of the ice engaged would be somewhat limited with a fixed drum position. Therefore the system of the present invention is designed to cut through ice 14 with an arcuate pivoting movement about the bow of the boat 10. As can be seen from FIG. 1, the support structure of the drum 18 facilitates pivotal motion thereof. The arcuate path of drum sway is preferably sufficiently broad so as to create a swath through the ice of a width greater than the boat 10. In this manner the boat 10 is capable of movement through an ice floe as well as the disaggregation of portions thereof with a relatively narrow drum 18. In operation the hydraulic system, as above referred to for driving the drum 18, may similarly be utilized to control the arcuate movement of the pivotally mounted drum 18 to provide the arcuate cutting swath.

The position and design of the disaggregation teeth 20 about the drum 18 are dependent upon the type of particulate matter engaged thereby. As seen in FIG. 6, the teeth 20 are formed with chipping-flanges 60 formed on the end of the supporting shank portions 62 thereof. This configuration is particularly adapted for ice removal. Other tooth configurations may be more suitable for various forms of particulate matter such as coal and/or shale. Similarly the positioning of the disaggregation teeth 20 upon the drum may be a function of the type of particulate matter engaged. As viewed in FIGS. 7 and 8, three groups of disaggregation teeth are provided in a descending spiral array along the drum for engaging the ice 14 at select intervals. This design maximizes the effective power provided to the drum 18 as above mentioned, but such a consideration may not always be pertinent. The cutting chipping teeth 40, 44 and 48 of upper array 51 are also seen to be provided in pairs to function as sledging members during ice disaggregation and for laterally isolating ridges of particulate matter. Other tooth spacing and configuration designs not shown herein are still within the teachings of the present invention. Similarly, although the slugging tooth 55 is shown to be generally centrally positioned between the rotative paths of the sledging teeth 29 other configurations may be functional and within the scope of the present invention.

It may thus be seen that the method and apparatus for disaggregating particulate matter such as ice with a rotatable drum may be effectively simplified and improved by the method and apparatus of the present invention. Moreover, the drum 18 as shown herein is provided with disaggregation teeth 20 of such a design and in such a configuration that cutting-chipping and disaggregation may be effected with a minimum of power. The engagement of the rotating drum 18 with particulate matter such as ice 14 although shown for purposes of illustration is not to be construed as limiting in that disaggregation of matter such as coal or shale is similarly within the purview of the discussion herein.

It is believed that the operation and construction of the invention will be apparant from the foregoing description. While the method and apparatus thereof shown and described has been characterized as being preferred, it will be obvious that various changes and modifications may be made therein without departing from the spirit and scope of the present invention.

What is claimed is:

1. A system for disaggregating particulate matter comprising:

a cylindrical drum adapted for engagement and rotative abutment with particulate matter;

an array of teeth extending generally radially outwardly from said drum and including:

first and second circumferentially oriented rows of sledging teeth adapted for cutting generally parallel serrations in the particulate matter and forming a laterally isolated ridge of matter therebetween as said drum is rotated, each of said rows of sledging teeth including a first, leading tooth and a second, trailing tooth, which second tooth extends outwardly further from said drum than said first tooth such that said second tooth engages and deepens the serrations made by said first tooth in the particulate matter;

a slugging tooth oriented generally axially between said first and second rows and circumferentially trailing said second teeth of both said first and second rows for striking said ridge formed by said sledging teeth proximate the base thereof, thereby imparting shear fracture thereto as said drum is rotated;

means for supporting said drum such that its axis is generally vertically oriented; and means for rotating said drum in engagement with the particulate matter and imparting sufficient force thereto for the disaggregation thereof.

2. The system of claim 1 in which said first teeth of both said first and second rows and said second teeth of both said first and second rows are, respectively, generally aligned parallel to the axis of said drum.

3. The system of claim 1 in which further includes, in each of said first and second rows, in each of said first and second rows, a third, intermediate tooth disposed between said first and second teeth, said second tooth extending from the surface of said drum further than said first tooth and not as far as said second tooth.

4. The system of claim 1 which further includes: a third circumferentially oriented row of sledging teeth including a first, leading tooth and a second, trailing tooth, said third row being displaced downwardly from said second row; and a second slugging tooth circumferentially trailing said second tooth in said third row and axially situated between said second and third row.

5. The system of claim 4 in which the first and second teeth in said third row are equally circumferentially offset from the corresponding teeth of said first row.

6. The system of claim 5 in which the teeth in said third row trail the corresponding teeth in said first row.

7. Apparatus for chipping and disaggregating ice to form a pathway through regions of ice-covered water, said apparatus comprising:

a craft adopted for movement upon ice-covered water and for applying a forward force therein;

a frame section having a top member and a bottom member and being secured to said craft in the frontal area thereof;

a generally cylindrical drum mounted for rotation between said top and bottom frame members and adapted for abutting engagement with the ice for disaggregation thereof;

an array of teeth extending generally radially outwardly from said drum and including:

first and second circumferentially oriented rows of sledging teeth adapted for cutting generally parallel serrations in the ice and forming a laterally isolated ridge of matter therebetween as said drum is rotated, each of said rows of sledging teeth including a first, leading tooth and a second, trailing tooth, which second tooth extends outwardly further from said drum than said first tooth such that said second tooth engages and deepens the serrations made by said first tooth in the ice;

a slugging tooth oriented generally axially between said first and second rows and circumferentially trailing said second teeth of both said first and second rows for striking said ridge formed by said sledging teeth proximate the base thereof, thereby imparting shear fracture thereto as said drum is rotated;

means for supporting said drum such that its axis is generally vertically oriented; and means for rotating said drum in engagement with the ice and imparting sufficient force thereto for the disaggreation thereof.

8. The apparatus of claim 7 which further includes means for moving said drum in sweeping oscillations before said craft in order to break a path in the ice which exceeds the width of said craft.

* * * * *